US007784139B2

(12) United States Patent
Sawalski et al.

(10) Patent No.: US 7,784,139 B2
(45) Date of Patent: Aug. 31, 2010

(54) SURFACE TREATING DEVICE WITH CARTRIDGE-BASED CLEANING SYSTEM

(75) Inventors: Michael M. Sawalski, Racine, WI (US); Jeffrey L. Harwig, New Berlin, WI (US); Stephen B. Leonard, Franksville, WI (US); Kathleen M. Laru, Racine, WI (US); Mark M. Gipp, Racine, WI (US); Thomas Jaworski, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 1610 days.

(21) Appl. No.: 11/051,312

(22) Filed: Feb. 4, 2005

(65) Prior Publication Data

US 2005/0229340 A1 Oct. 20, 2005

Related U.S. Application Data

(60) Provisional application No. 60/542,115, filed on Feb. 4, 2004.

(51) Int. Cl.
*A47L 11/24* (2006.01)
*A47L 11/36* (2006.01)

(52) U.S. Cl. ..... 15/50.3; 15/319; 15/340.3

(58) Field of Classification Search ..... 15/50.3, 15/319, 340.1, 340.3, 340.4
See application file for complete search history.

(56) References Cited

U.S. PATENT DOCUMENTS

| | | | | |
|---|---|---|---|---|
| 848,974 | A | 4/1907 | Crossman | |
| 1,168,189 | A | 1/1916 | Garlock | |
| 1,386,369 | A * | 8/1921 | Schwimmer | 312/34.16 |
| 1,536,687 | A | 5/1925 | Oatey | |
| 1,727,524 | A | 9/1929 | Spencer | |
| 1,919,067 | A | 7/1933 | Lang et al. | |
| 2,407,408 | A | 9/1946 | Erickson | |
| 2,476,537 | A | 7/1947 | Erickson | |
| 3,233,267 | A | 2/1966 | Jagiel | |
| 3,336,621 | A | 8/1967 | Jeske | |
| 3,750,223 | A * | 8/1973 | Leifheit | 15/50.3 |
| 3,849,826 | A | 11/1974 | Kaisha | |
| 4,083,075 | A | 4/1978 | Hester | |
| 4,433,451 | A | 2/1984 | Parisi | |
| 4,445,245 | A | 5/1984 | Lu | |
| 4,510,642 | A * | 4/1985 | Ingermann et al. | 15/231 |
| 4,550,467 | A | 11/1985 | Johnson et al. | |
| 4,577,364 | A | 3/1986 | Demetriades | |
| 4,912,805 | A | 4/1990 | Krasznai et al. | |
| 4,967,440 | A | 11/1990 | Belanger | |
| 5,127,123 | A | 7/1992 | Belanger | |
| 5,203,047 | A | 4/1993 | Lynn | |

(Continued)

FOREIGN PATENT DOCUMENTS

| | | |
|---|---|---|
| WO | WO 02/00819 | 1/2002 |

*Primary Examiner*—Randall Chin

(57) ABSTRACT

A cartridge is disclosed comprising a reel-to-reel roll of cleaning material, for use in a hand-held or robotic cleaning device. The cartridge provides either an electrostatic dust cloth or wet mop, and includes a fluid reservoir for maintaining the wet mop cloth during use. A dust bin is also provided on the cartridge, and includes a hinged lid for providing selective access to the dust inside of the bin. A motor, optical sensor, and fluid pump inside of a cleaning apparatus control the operation of the reel-to-reel cloth, and control fluid delivery to the wet cloth.

12 Claims, 8 Drawing Sheets

U.S. PATENT DOCUMENTS

| | | | | |
|---|---|---|---|---|
| 5,594,971 | A | 1/1997 | Nelson | |
| 5,896,611 | A | 4/1999 | Haaga | |
| 5,933,900 | A | 8/1999 | Wang | |
| 5,940,928 | A | 8/1999 | Erko | |
| 5,996,167 | A | 12/1999 | Close | |
| 6,212,725 | B1 | 4/2001 | Porat | |
| 6,223,378 | B1 * | 5/2001 | Watellier | 15/103.5 |
| 6,295,687 | B1 | 10/2001 | Dehart | |
| 6,311,356 | B1 * | 11/2001 | Wang | 15/99 |
| 6,459,955 | B1 | 10/2002 | Bartsch et al. | |
| 6,532,619 | B2 | 3/2003 | Kasper et al. | |
| 6,594,844 | B2 | 7/2003 | Jones | |
| 6,741,054 | B2 * | 5/2004 | Koselka et al. | 318/445 |
| 6,859,976 | B2 * | 3/2005 | Plankenhorn | 15/380 |
| 6,966,098 | B2 * | 11/2005 | Sako et al. | 15/364 |
| 7,251,853 | B2 * | 8/2007 | Park et al. | 15/319 |
| 7,320,149 | B1 * | 1/2008 | Huffman et al. | 15/320 |
| 2002/0011813 | A1 | 1/2002 | Koselka et al. | |
| 2003/0159223 | A1 | 8/2003 | Plankenhorn | |
| 2009/0100494 | A1 | 4/2009 | Teal | |

* cited by examiner

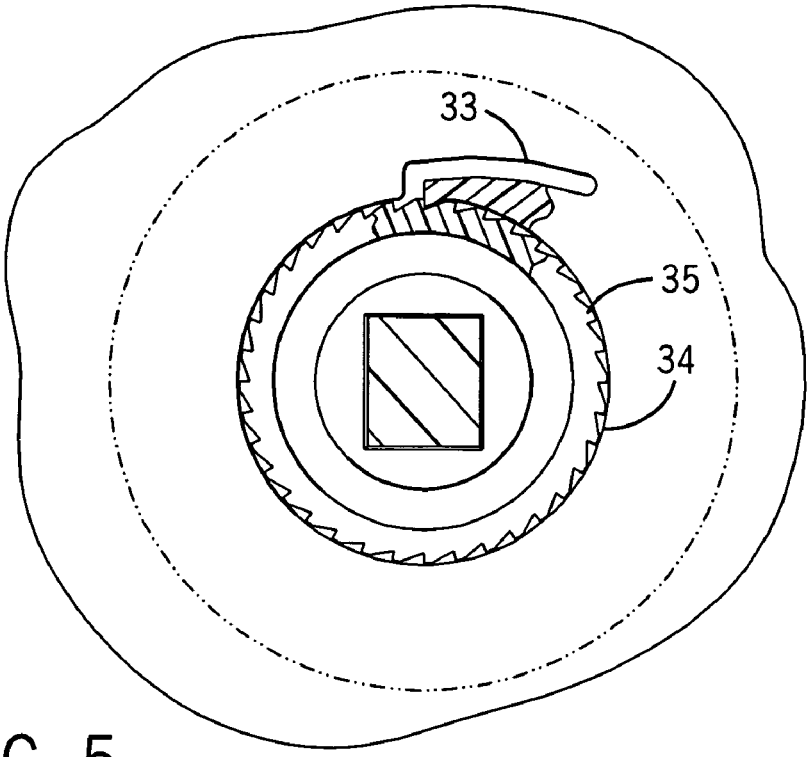
FIG. 5
FIG. 6
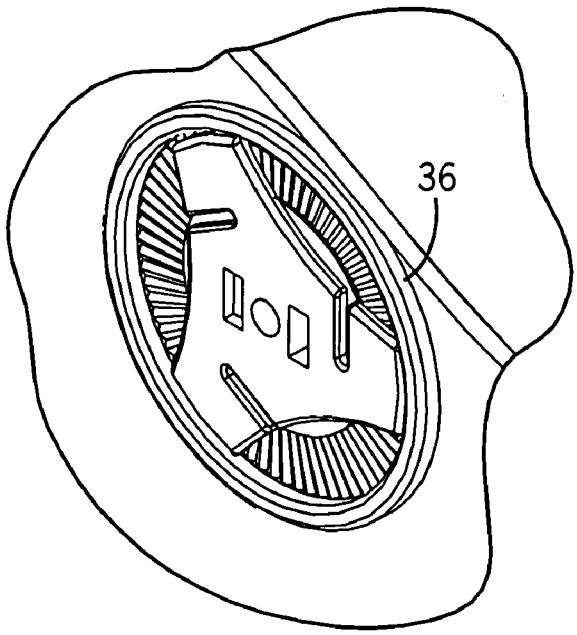

SURFACE TREATING DEVICE WITH CARTRIDGE-BASED CLEANING SYSTEM

CROSS REFERENCE TO RELATED APPLICATIONS

This application claims priority to U.S. provisional application Ser. No. 60/542,115, filed Feb. 4, 2004.

STATEMENT REGARDING FEDERALLY SPONSORED RESEARCH/DEVELOPMENT

Not applicable

BACKGROUND OF THE INVENTION

It is desirable to minimize the amount of human labor expended in maintaining and cleaning residential and commercial spaces. The art has therefore developed robotic devices that can clean or otherwise maintain or treat floors, carpeting or the like without the necessity for a human to be present during the operation of the device. The most common robotic devices of this kind are dusters, buffers, vacuum cleaners, floor sweepers, and floor polishers.

Such devices typically have a computer control program to direct a preferred movement pattern. The control is linked to steering devices as well as motors that are in turn connected to wheels. Many of these devices also include sensors to confirm the initial and later positions of the device relative to the pre-set path. The most sophisticated of these devices include sensors to detect the presence of unexpected obstacles, as well as programming to provide options for altered paths where that occurs. An example of a prior art control system for such a robotic system is disclosed in U.S. Pat. No. 4,119,900. See also U.S. Pat. No. 6,594,844.

As these devices are intended to be operated autonomously, and for a significant period of time, it is desirable to provide a supply of cleaning materials which is renewable and which does not require significant maintenance. It is also desirable that various types of cleaning supplies for various types of cleaning and floor surfaces can also be provided, in order to provide multiple cleaning functions from a single device. Various types of cleaning should not only be available, but easily implemented on the autonomous cleaning device.

Known in the art are various methods for providing a length of cleaning material in a reel to reel configuration. U.S. Pat. No. 4,433,451, for example, depicts a floor cleaning device which is designed to have a reel-to-reel cloth 33 that is advanced during use. The cloth is used for cleaning and/or drying the floor, and may be a non-woven fabric. An elastic compression element 41 forces the cloth towards the floor. The system is described as also being capable of delivering liquid.

Another such system is disclosed in U.S. Pat. No. 4,510,642 which describes the use of a mechanism for tightening a dusting cloth in a reel-to-reel system used for one type of flooring, here a bowling lane.

Also known in the art are removable cleaning elements. U.S. Pat. No. 5,933,900, for example, discloses a floor cleaning machine which can include a removable dust pan.

While several devices for advancing cleaning materials through a cleaning device with minimal maintenance are known, these devices each require a significant interaction between a user and the dirt-collecting material. Furthermore, once these devices are installed, they are not easily replaced when, for example, a different type of cleaning or a different floor surface is encountered, or when the cleaning material is either used-up or soiled to the point of inefficiency.

In sum, a need still exists for improved surface treating devices, particularly those that can easily and efficiently provide multiple cleanings, and which can easily and efficiently be removed and replaced when a different type of cleaning is required. These types of devices are particularly desirable for use in robotic or other autonomous applications.

SUMMARY OF THE INVENTION

The present invention provides an autonomous/robotic surface treating device. The surface treating device typically includes a housing having an aperture sized and dimensioned to receive a cleaning cartridge, a sweeper brush coupled to the housing, and a motor positioned adjacent the aperture for driving a roll of sheet cleaning material on the cartridge, as a surface is treated.

In another aspect of the invention, the surface treating device includes a pump for delivering a fluid onto the roll of sheet cleaning material. Alternatively, the fluid may be deposited upon the surface to be cleaned. The device can also include an optical sensor for monitoring the roll of sheet cleaning material as it is driven through the cleaning device. A controller for driving the motor and the pump, and for monitoring the optical sensor, can also be provided.

In yet another aspect of the invention, a cartridge for use in a cleaning device is provided. The cartridge includes a housing, a resistive supply reel coupled to an axle in the housing, and a take-up reel coupled to an axle in the housing. A dust bin is positioned adjacent an edge of the housing, and a cleaning material is provided in the housing, a first end of the cleaning material is coupled to the resistive supply reel, and the opposing end is coupled to the take-up reel.

In another aspect of the invention, the cartridge further includes a platen extending toward the surfaced to be cleaned from a bottom surface of the housing. A portion of the roll of cleaning material extends over the platen between the supply reel and the take-up reel, providing a cleaning surface. The platen can be compliant. The cartridge can also include a fluid port for receiving a pumped fluid supply, particularly for use in wet mopping, and a fluid reservoir for providing the fluid to the roll of cleaning material.

In yet another aspect of the invention, the cartridge can include a lid provided on the dust bin, the lid being opened when the cartridge is in use, and closed when the cartridge is removed to prevent dust and dirt from spilling from the bin. The lid can be hinged to provide this function. A flexible blade may be provided adjacent the dust bin and directed toward the dust bin to direct dirt into the dust bin.

The cartridge of the invention can also include a window for viewing the roll of cleaning material in the cartridge.

In yet another aspect of the invention, the cartridge can be employed in either a hand operated device, or an autonomous or robotic device.

In other aspects of the invention, the cartridge can include a cleaning material which comprises an electret or electrostatic dusting material, or, in the alternative, a wet mop material. Still further, the cleaning material may be provided as folded supply, such as an accordion folded stack of nonwoven sheets of cleaning material, which material may be withdrawn for use and placed in an operative position either by hand or by mechanical means. The cleaning material may also be provided in a roll.

This brief summary of the invention has been provided so that the general nature of the invention may be readily understood. However, neither this summary, nor the attached drawings, nor the description of the preferred embodiments which follows, should be constructed to limit the invention. Rather, the claims should be looked to in order to assess the full scope of the invention.

BRIEF DESCRIPTION OF THE DRAWINGS

FIG. 5 is a cutaway detail view of the cartridge illustrating the ratcheted take-up reel.

FIG. 6 is a cutaway detail view of the cartridge illustrating the supply reel.

DETAILED DESCRIPTION OF THE PREFERRED EMBODIMENT

Figure 1:
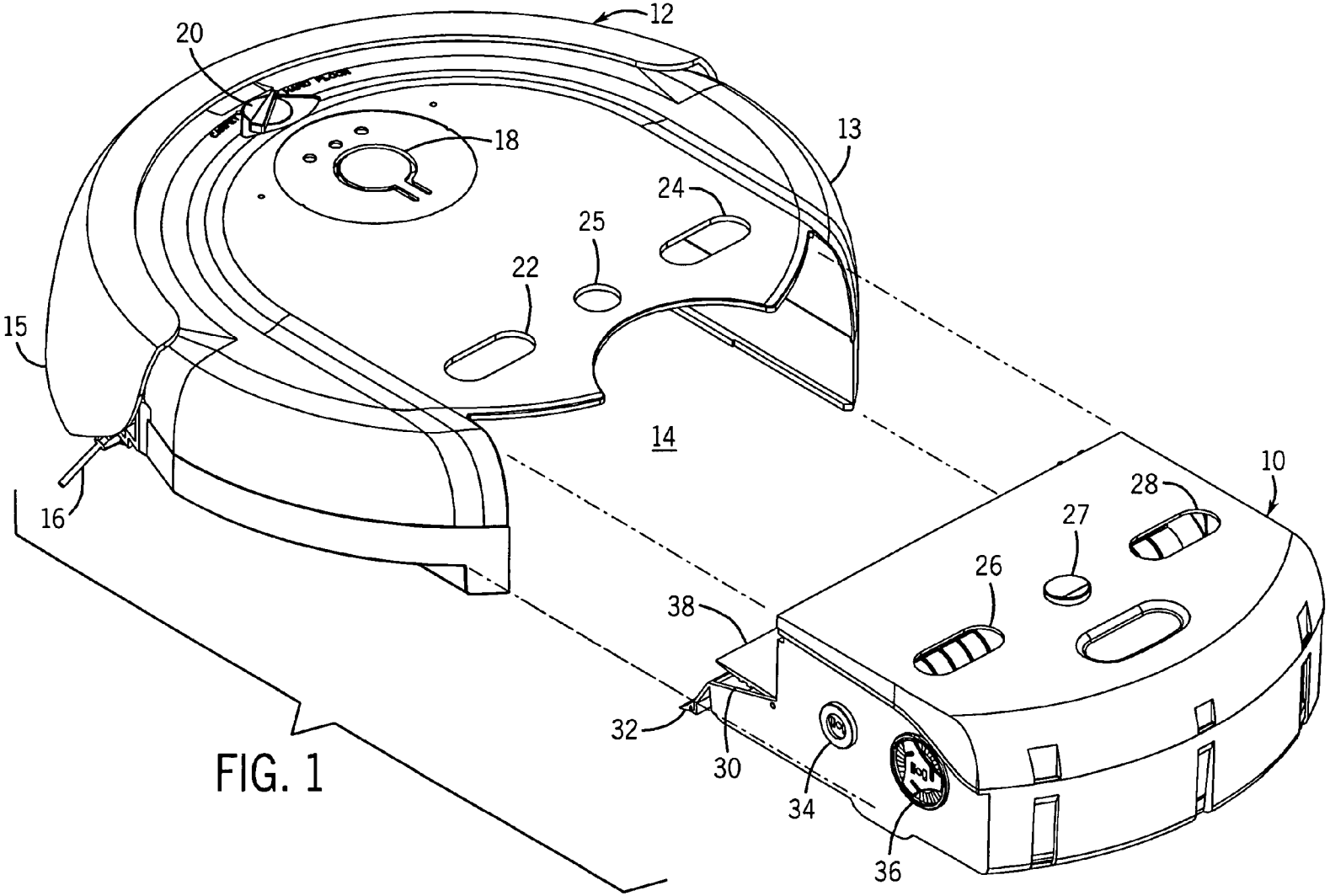
FIG. 1 is an exploded view illustrating a cleaning cartridge constructed in accordance with the present invention being inserted into a back end of an autonomous cleaning device of the present invention.
Figure 3:
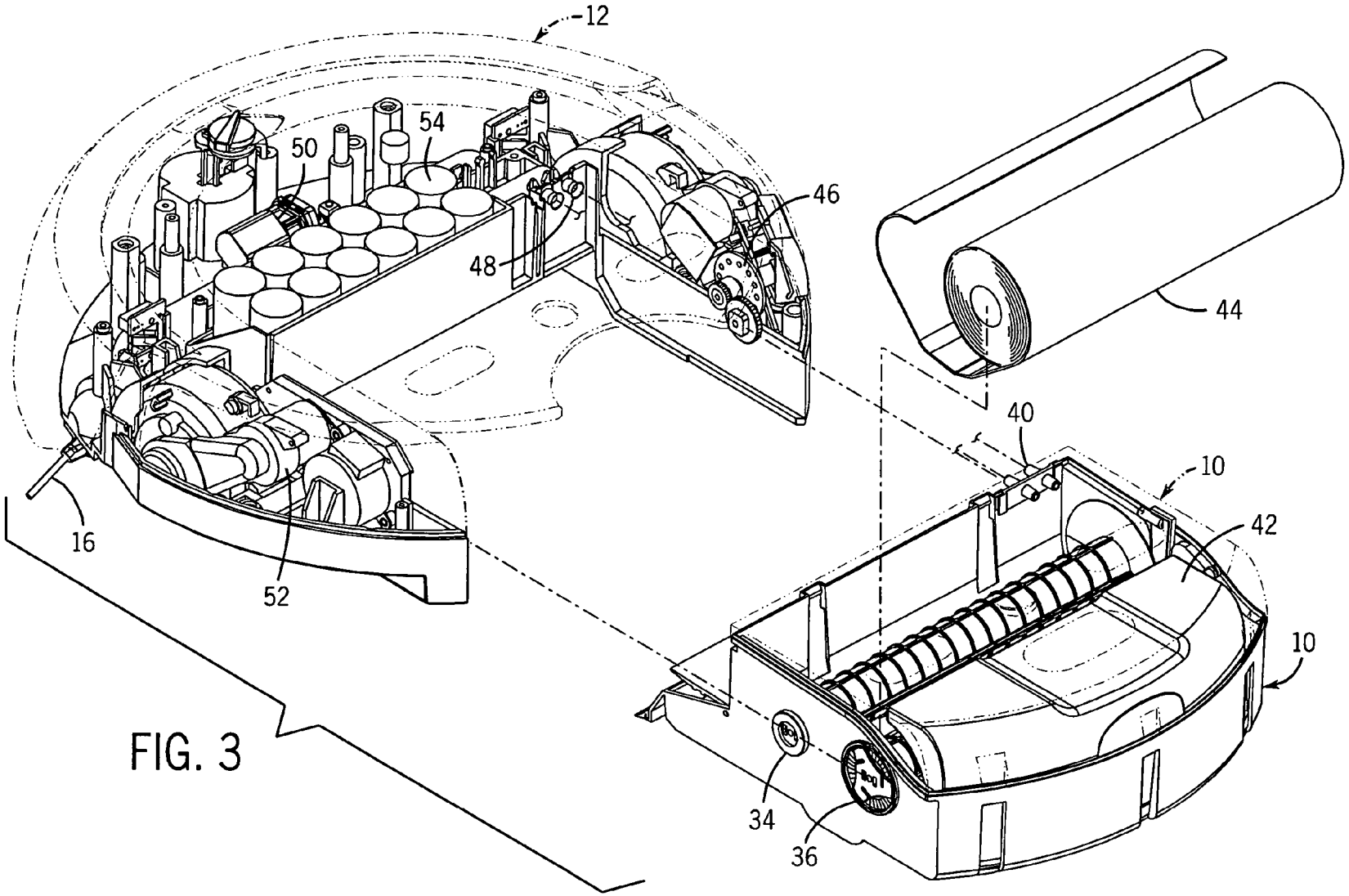
FIG. 3 is the view of FIG. 1, with upper housings removed from the autonomous cleaning device and the cartridge.

Referring now to the figures and more particularly to FIGS. 1 and 3, a cleaning system comprising a cleaning cartridge 10 for insertion into a cleaning device 12 is shown. The cleaning cartridge 10 comprises a roll of sheet cleaning material 44 which is provided in a reel-to-reel configuration in the cleaning cartridge 10, as described below. A portion of the roll of sheet cleaning material is maintained in contact with the surface below the cleaning device 12 during operation. A motor 52 is provided in the cleaning device 12 to consistently drive the used cleaning sheet material out of contact with the surface to be cleaned in order to maintain an effective cleaning process as the cleaning system is used.

Figure 2:
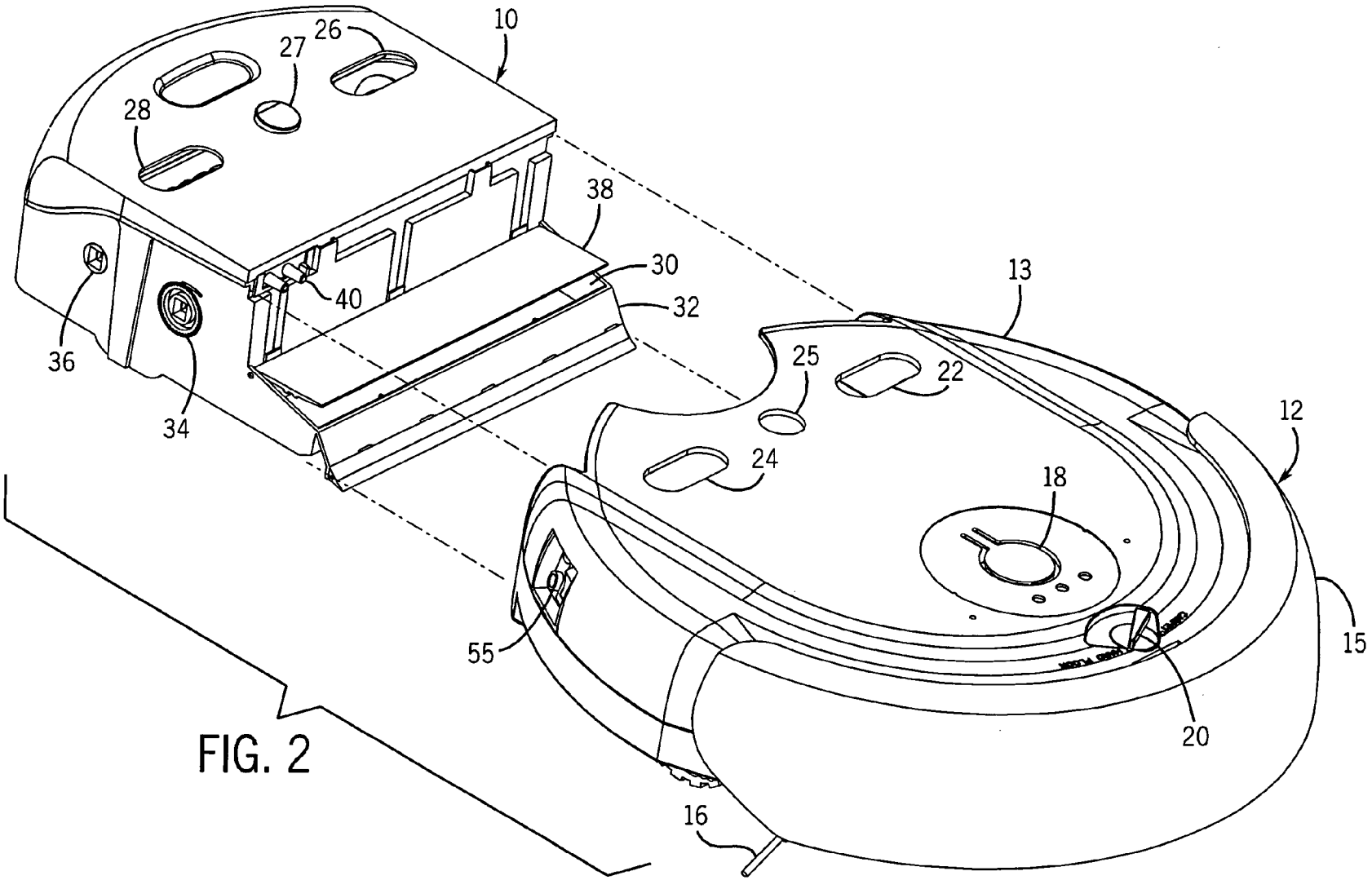
FIG. 2 is an exploded view as described with reference to FIG. 1, although viewed from the front upper left of the autonomous cleaning device.
Figure 4:
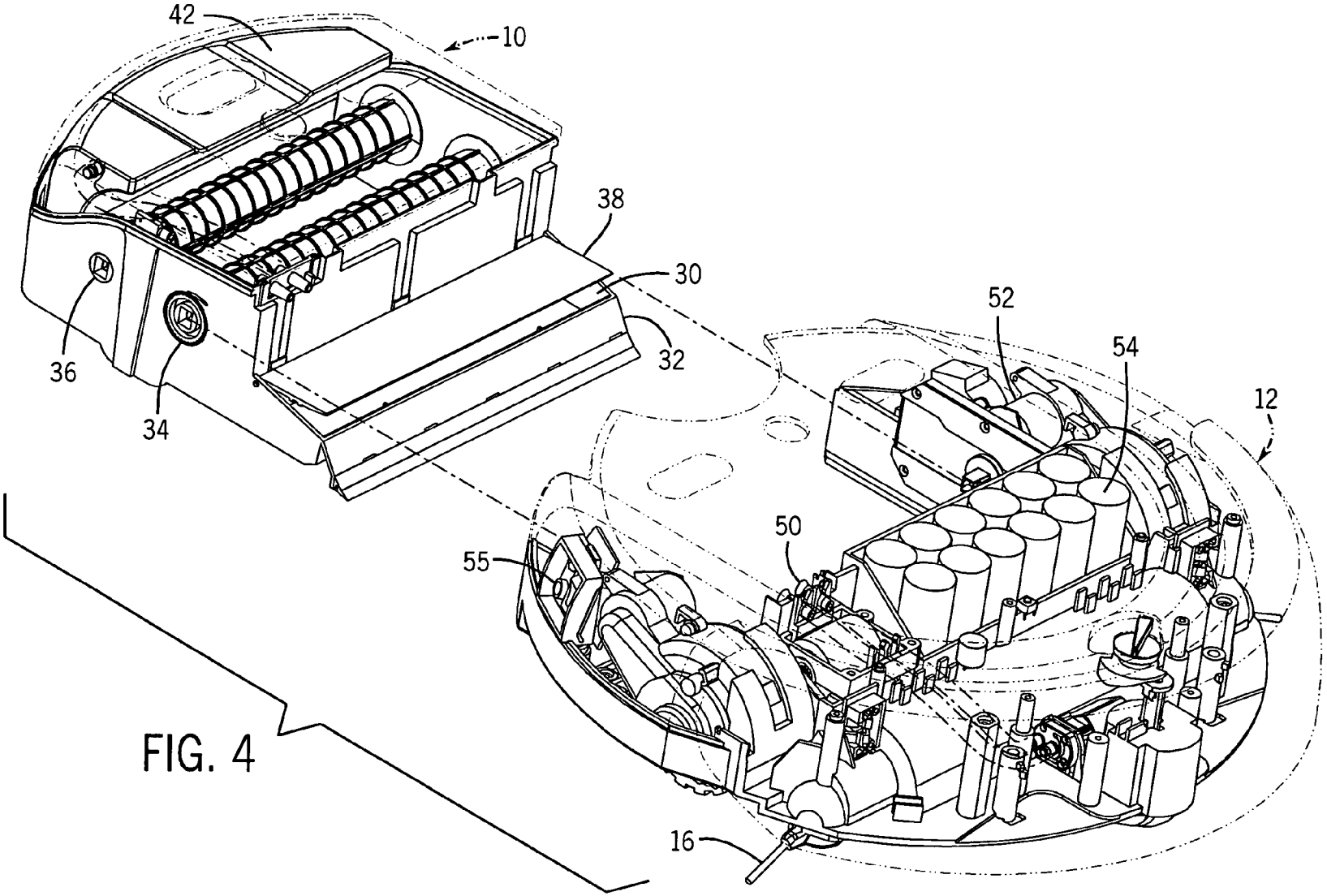
FIG. 4 is the view of FIG. 2, with upper housings removed from each of the autonomous cleaning device and the cartridge
Figure 7:
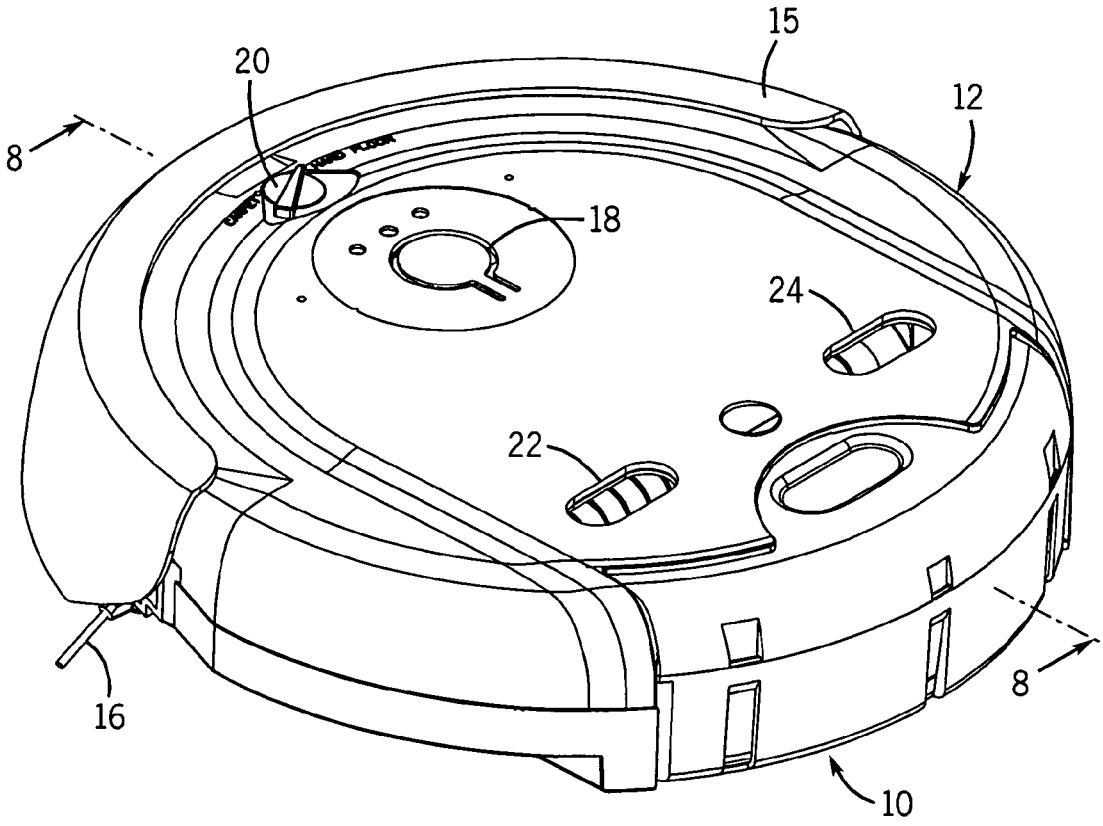
FIG. 7 is atop plan view of the autonomous cleaning device with the cartridge inserted.
Figure 8:
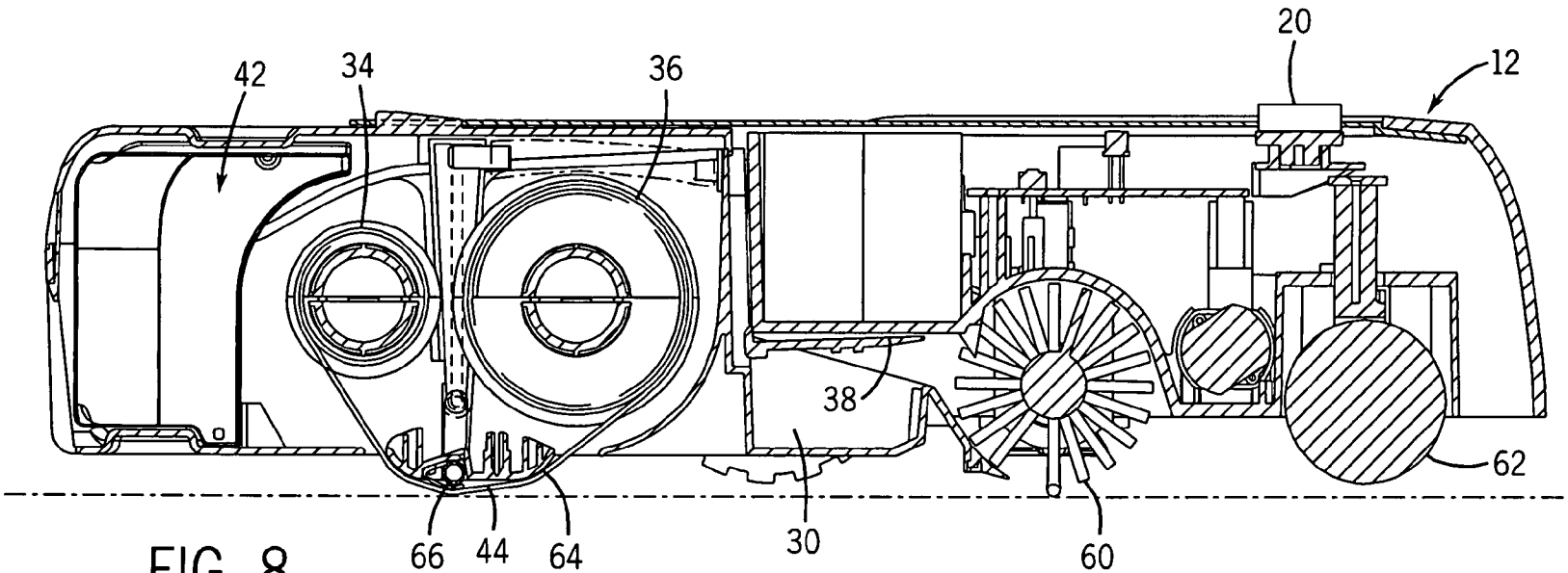
FIG. 8 is a view taken along the line 8-8 of FIG. 7.

Referring still to FIGS. 1 and 3 and also to FIGS. 2 and 4, the cleaning device 12, as shown, comprises an autonomous appliance or robot which includes a housing 13 having an aperture 14 sized and dimensioned to receive the cleaning cartridge 10. In the housing 13 and located above the aperture 14 are two windows 22 and 24 which allow the user to view the cleaning cartridge 10, and the roll of cleaning sheet material 44 maintained therein. An aperture 25 is also provided which, in conjunction with a latching device 27 on the cartridge 10, provides a latch for selectively connecting the cartridge 10 to the cleaning device 12. As shown in FIG. 8, the cleaning device 12 also includes a sweeper or beater brush 60 for cleaning large particulate matter. The cleaning sheet material 44 follows the brush 60 and typically cleans smaller particulate matter such as hair and dust which is not picked up by the brush 60.

Referring still to FIGS. 1 and 2, the cartridge 10 includes windows 26 and 28 which, when positioned in the cleaning device 12, are aligned with the windows 22 and 24 in the housing 13 of the cleaning device 12, thereby allowing a user visual access to the cleaning sheet material 44 within the cartridge 10. Although many types of materials could be used, the cartridge is preferably constructed of a low cost resin such as injection-molded PE or PP, which are compatible with cleaning fluids. The windows 26 and 28 are preferably enclosed with a transparent material.

A dust bin 30 is provided in the cleaning cartridge 10 at the end of the cartridge which is received inside of the housing 13 of the cleaning device 12, wherein, when in position, the dust bin 30 is provided adjacent the brush 60 (FIG. 8) in the cleaning device 12. The dust bin 30 is selectively covered by a hinged lid 38, which is forced open as the cleaning cartridge 10 is moved into the cleaning device 12 but which swings shut and is therefore normally closed when the cartridge is removed from the cleaning device 12, thereby retaining dust collected by the cleaning device 12 within the dust bin 30 for cleaning, replacement, or disposal of the cartridge 10. Optionally, the dust bin may be provided with a disposable bag for accumulation and disposal of dust collected by the cleaning device. A flexible blade 32 which can be constructed, for example, of rubber, flexible plastics, or other materials which will be known to those of skill in the art, is provided in front of the dust bin 30, directed from an upper edge of the dustbin 30 to the surface below the cartridge 10. As described below, in operation, the flexible blade 32 directs dirt collected by the brush 60 of the cleaning device 12 into the dust bin 30. In another possible embodiment of the present invention, the dust bin may be positioned within the body of the device, rather than in the cleaning cartridge. Furthermore, although a hinged lid is described, a sliding lid or other types of lids which are operable upon insertion into the robot and closable upon removal from the robot can also be used.

Referring still to FIGS. 1-4, the reel-to-reel device provided in the cartridge 10 includes both a take-up reel 34, to which used cleaning sheet material 44 is directed, and a supply reel 36, to which an unused roll of cleaning sheet material is connected. The take-up reel 34 (FIG. 5) is ratcheted in order to prevent used cleaning sheet material 44 from being directed back over the. surface to be cleaned, while the supply reel 36 (FIG. 6) provides a resistive force limiting rolling, of the sheet unless driven, for example, by stepper motor 52. Teeth 35 in the take-up reel 34 are engaged with spring-loaded teeth 33 to ratchet the reel and limit motion.

The cleaning sheet material 44 can comprise, for example, an electrostatic or electret material. Examples of such materials are those described in WO 02/00819, the publication for PCT/US00/20074 filed Jun. 22, 2001. This disclosure is incorporated herein by reference for a description of these types of materials. The cleaning sheet material may be either woven or nonwoven, and may be non-absorbent for use as a dust cleaning material, or absorbent for use with a wet cleaning agent, for example. Moreover, the cleaning sheet material may be of any suitable thickness, to the extent that the material thickness may improve compliance of the device to the surface being cleaned, without interfering with traction of the drive wheels of the device. Further, when the device is to be used for a hard surface, an anti-slip routine may be provided in the robotic controls so as to ensure traction of the wheels when the surface is wet. The cleaning sheet material 44 can also provide a treating or dispensation function. For example, the cleaning cloth can be treated with cleaning fluid or polishes to treat the floor, with insecticides, insect repellants, and fragrances to be dispersed to a room, or with a combination of these treating elements. Furthermore, various sections of the cleaning cloth 44 can comprise different types of material, providing, for example, a cleaning section and a polishing section. Other combinations will be apparent.

Referring still to FIGS. 1-4, the cartridge 10 can further comprise a fluid reservoir 42 for providing a fluid to the cleaning sheet material 44 during operation. Alternatively, the fluid may be distributed directly to the surface being treated, rather than to the cleaning sheet material, said distribution providing a metered amount of fluid to optimize effectiveness. As described above, the fluid can be water, a cleaning fluid, polish, insecticide, or various other materials, or a combination of such materials. The fluid supply provided in the reservoir 42 is preferably connected to a pump 50 provided in the cleaning device 12 through fluid inlets 40 provided on the cartridge 10 and fluid outlets 48 provided on the cleaning device 12. In operation, therefore, the control of fluid flow to the cleaning sheet material 44 is controlled by the cleaning device 12, and is provided to the sheet material to maintain a selected level of moisture over the life of the cartridge, as described below. Alternatively, the amount of fluid used may be controlled by the user. Although the size of the reservoir will typically be determined based on the application, in the application shown here the fluid reservoir 42 is 450 ml. In another embodiment of the invention, the sheet material may be dispensed from a reservoir of fluid so as to provide a fluid saturated sheet material, the sheet material then being drawn through such means as a pinch roll or squeegee means to appropriately limit the amount of fluid in said sheet material prior to contact of the material with the surface to be cleaned. When a wet cleaning material is employed, care must be taken to provide an openable and closeable aperture through which the material passes for use, so as to prevent dry-out of the material prior to use. Advancement of the sheet material, either as a roll or as individual sheets, may be controlled mechanically, such as by metering means on the drive wheel or the brush mechanism. The take-up reel may be located in the cartridge, or external thereto. Moreover, the sheet material may be provided in such a manner that used portions of the cleaning material may be removed, such as by tearing away at perforations, so as to prevent wet sheet material being retained within the cartridge or the body of the cleaning device and causing mold formation, for example. Such removal may be hand done by the consumer, or may be automatically controlled by the device. Further, the cleaning material, after usage, may be retained in a receptacle bin within either the cartridge or in the body of the cleaning device, for disposal at the convenience of the user.

Referring still to FIG. 3 and also to FIG. 4, a bank of batteries 54 provides power to the cleaning device, which is selectively activated by a switch 18 (FIG. 1) provided on the cleaning device 12. The batteries are preferably rechargeable, and are accessed through a port 55 provided in the side of the housing of the cleaning device 12 (FIG. 2).

The cloth supply reel 36 is driven by the stepper motor 52 provided in the cleaning device and the amount of the roll of the sheet material 44 which is unwound during operation is monitored by a sensor such as an optical sensor 46, which is also provided in the cleaning device 12. The stepper motor 52, optical sensor 46, and pump 50 are each driven by a microprocessor control board or controller (not shown, but positioned typically above the battery pack) based on an experimentally-determined timing which drives the stepper motor to replace the sheet material as necessary to maintain proper cleaning processes during a cleaning operation while monitoring actual movement of the sheet. Similarly, the controller drives the pump 50 to supply fluid to the roll of sheet material 44 as necessary during cleaning, the timing for replenishment of the fluid source also being determined experimentally based on the type of material and fluid being employed, and in the expected life of the roll of cleaning sheet material 44. The controller preferably maintains the cleaning sheet material 44 in a constant tension, and, while in use, indexes at a predetermined rate, as for example, 0.75 inches per 5 minutes or thereabout, over the life of the cartridge.

The stepper motor 52 is coupled to the take-up reel 34 through a series of gears, while the supply reel is coupled to the optical sensor which detects the amount of rotation of the supply wheel. Means may be provided to advance the cleaning material in such a manner as to measure and control the amount of cloth advanced from the supply reel to the take-up reel, to compensate for differing rates of advance as material is transferred from one reel to the other. Such means may be automatic, or may be manual so as to be adjustable by the consumer.

Figure 9:
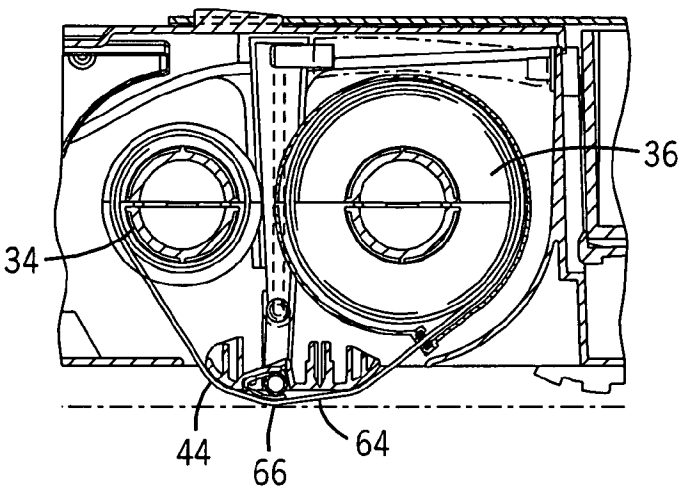
FIG. 9 is a cutaway view of FIG. 8, illustrating the reel-to-reel spooling of a cleaning sheet material in the cartridge.

Referring now to FIGS. 8 and 9 a top view and a cutaway side view of the cartridge 10 as inserted in the cleaning device 12 are shown, respectively. As described above, the cleaning device 12 includes a beater or sweeping brush 60. A wheel 62 at the front of the cleaning device 12 is adjustable by activation of a switch 20 between at least two positions, one selected for use with a carpet, and another for use with a hard floor surface. As the cartridge 10 is inserted into the robot 12 the flexible blade 32 is positioned adjacent the main brush 60 and receives the relatively large particulate matter collected by the brush as the cleaning device 12 is run across a floor surface. The particulates are directed up the flexible blade 32 by the main brush 60 and into the dust containment bin 30 as described above, in operation the hinged lid 38 is retained in an open position such that the dust and particulate matter can be readily directed into the containment bin 30. Following behind the main brush 60 is the cartridge 10 including the cleaning sheet material 44. The cleaning sheet material 44 is retained against the surface to be cleaned by a platen 66 which includes a leaf-spring 64 that insures contact between the surface to be cleaned and the cleaning cloth 44. Also as described above, the reservoir 42 is provided adjacent the cleaning material 44 such that fluids can be applied to replenish the cloth when a wet or moist mop cloth is employed in the cleaning device 12. It is also to be noted that the platen, 66, may incorporate material, such a plastic or rubber edge, attached thereto to improve compliance of the cleaning material to the surface being cleaned. Moreover, the platen need not be rigid, but may be able to float or vary in height from said surface relative to the wheels of the device.

Figure 10:
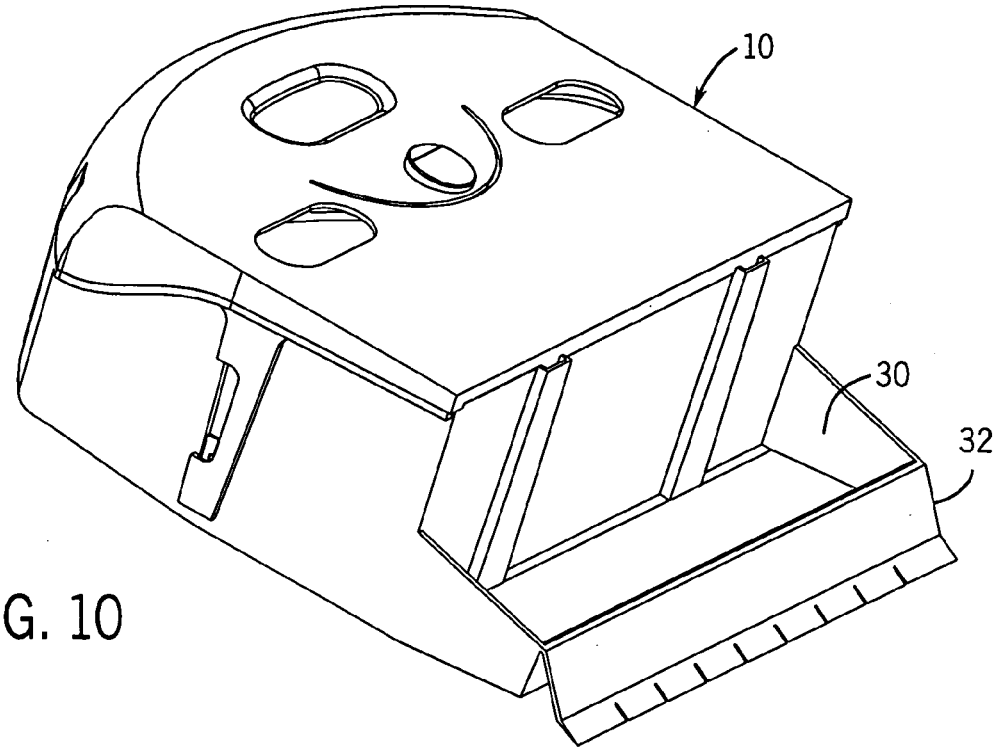
FIG. 10 is a top plan view of a cartridge for cleaning carpeting.
Figure 11:
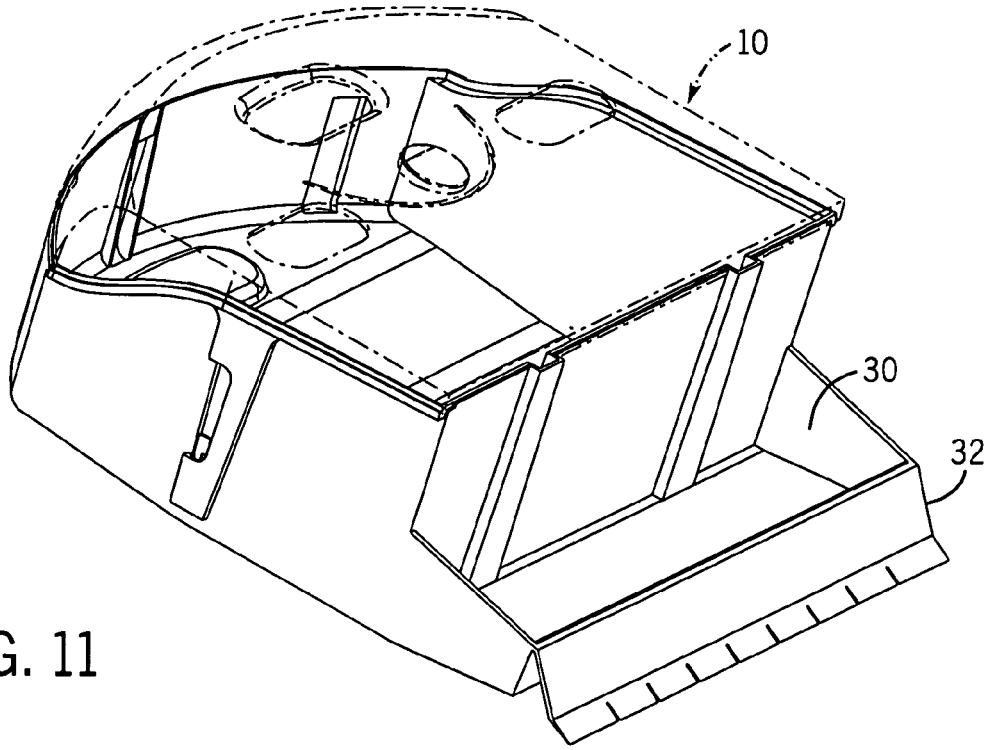
FIG. 11 is a top plan view of the cartridge of FIG. 10 with the top housing removed.

Although a cartridge employing a cleaning sheet material 44 for use on a hard surface has been shown and described, a cartridge 10 for use with a soft surface, such as a carpet, may also be provided. Referring now to FIGS. 10 and 11, a cartridge for carpet cleaning is shown. Here, the cartridge comprises a larger dust containment bin 30, shown without a cover, and is weighted appropriately to maintain the cleaning device 12 against the surface to be cleaned, and in an upright position during the cleaning operation.

The cartridge 10 provides advantages over the prior art in that various cleaning operations can be provided in interchangeable cartridges which can be easily removed and replaced when a different cleaning process is required. Furthermore, the cartridges can be disposed of when the roll of cleaning sheet material 44 and/or the fluid in the fluid reservoir 42 is spent. Furthermore, even before the cleaning material is spent, the cartridge 10 can be removed and the dust bin 30 emptied by the user with minimal dust dispersion.

As described above, the cleaning device 12 comprises an autonomous robot. The robot 12 includes a bumper 15 at a front end and side brushes 16 which aid in the cleaning process. The robotic device further includes an activation switch 18, which activates a navigational system for directing the robot about the surface to be cleaned. Although a robotic device is shown and described, it will be apparent that the cartridge device 10 as shown and described could also be employed in a hand driven device.

Furthermore, although a specific configuration for the fluid supply and pump has been shown, it will be apparent that a pump could also be provided in the cartridge. Furthermore, pre-moistened materials capable of maintaining fluids over periods of time could alternately be used. Here, for example, a wet cloth can be maintained in a tightly fitting slot formed in an elastomeric material, which will help retain moisture within the wet roll and prevent excessively wet cloth from being dispersed.

While a combination dusting and sweeping device has been shown, the principles of the present invention also apply to dusters, mops, vacuum cleaners, floor polishers and a wide variety of other surface treating equipment. Although a sweeping device has been shown and described in combination with a dusting or, mopping element, it will be apparent that the dusting or mopping element could also be used independently of the sweeper. Thus, although specific embodiments of the present invention have been described in detail, it should be understood that this description is merely for purposes of illustration.

Various modifications of these embodiments may be made without departing from the spirit or scope of the following claims. Thus, the claims should be looked to in order to assess the full scope of the invention.

INDUSTRIAL APPLICABILITY

Disclosed are improved surface treating devices, methods for using them, and cartridge devices for providing various cleaning elements, either in a robotic or hand-held system.

We claim:

1. A robotic surface treating device, comprising:

a housing including an aperture sized and dimensioned to receive a cleaning cartridge;

a sweeper brush coupled to the housing; and a cleaning cartridge comprising:

a supply reel coupled to a first axle;

a take-up reel coupled to another axle; and a roll of sheet cleaning material mounted on the reels; and a dust bin positioned between the sweeper brush and the roll of sheet cleaning material, the dust bin having a lid mounted thereon suitable to automatically pivot from a closed position to an open position as the lid moves into the cleaning device, and suitable to automatically pivot from an open position to a closed position as the lid moves out of the cleaning device;

wherein the housing is configured to force open the lid as the dust bin moves into the cleaning device;

wherein there are means for moving said cleaning material relative to the surface to be treated; and whereby the device is suitable to cause particulate matter on the surface to be removed from the surface and sent to the dust bin before the sheet cleaning material passes over where that particulate matter was previously on the surface.

2. The robotic surface treating device as defined in claim 1, further comprising a pump for delivering a fluid onto the sheet cleaning material.

3. The robotic surface treating device as defined in claim 1, wherein there is also a flexible blade;

wherein there is also a ratchet linked to the take-up reel to permit the sheet of cleaning material to move onto the take-up reel, but to restrict movement of a used portion of the sheet of cleaning material, if present, back off the take-up reel; and wherein the dust bin is positioned rearward of the flexible blade and forward of the roll.

4. The robotic surface treating device as defined in claim 3, further comprising a platen extending from a bottom surface of the cartridge, the roll of cleaning material extending by the platen between the supply reel and the take-up reel.

5. The robotic surface treating device as defined in claim 4, further comprising a fluid inlet port for receiving a fluid supply.

6. The robotic surface treating device as defined in claim 4, wherein the flexible blade is suitable to direct dirt into the dust bin.

7. The robotic surface treating device as defined in claim 4, wherein the platen is compliant.

8. The robotic surface treating device as defined in claim 3, further comprising a fluid reservoir for providing a fluid to the roll of cleaning material.

9. The robotic surface treating device as defined in claim 3, further comprising a latching device for latching the cartridge into the housing.

10. The robotic surface treating device as defined in claim 3, wherein the cleaning material comprises an electrostatic dusting material.

11. The robotic surface treating device as defined in claim 3, wherein the cleaning material comprises a wet mop material.

12. A refill cleaning cartridge suitable for use with a robotic surface treating device of a type having a housing with an aperture sized and dimensioned to receive the cleaning cartridge, and a sweeper brush coupled to the housing, the refill cleaning cartridge comprising:

a supply reel coupled to a first axle;

a take-up reel coupled to another axle; and a roll of sheet cleaning material mounted on the reels; and a dust bin positionable between the sweeper brush and the roll of sheet cleaning material, the dust bin having a lid mounted thereon suitable to automatically pivot from a closed position to an open position as the lid moves into the housing of the cleaning device, and suitable to automatically pivot from an open position to a closed position as the lid moves out of the housing of the cleaning device;

wherein the lid is configured to be forced open as the dust bin moves into the housing of the cleaning device;

wherein there are means for moving said cleaning material relative to the surface to be treated; and whereby the cartridge, when used with a robotic surface treating device, is suitable to cause particulate matter on the surface to be removed from the surface and sent to the dust bin before the sheet cleaning material passes over where that particulate matter was previously on the surface.

* * * * *